US011834792B2

(12) United States Patent
Campbell et al.

(10) Patent No.: US 11,834,792 B2
(45) Date of Patent: Dec. 5, 2023

(54) PAPER STRENGTH IMPROVEMENT USING METAL CHELATES AND SYNTHETIC CATIONIC POLYMERS

(71) Applicant: KEMIRA OYJ, Helsinki (FI)

(72) Inventors: Clayton Campbell, Atlanta, GA (US); Junhua Chen, Atlanta, GA (US); Zheng Dang, Atlanta, GA (US)

(73) Assignee: Kemira OYJ, Helsinki (FI)

( * ) Notice: Subject to any disclaimer, the term of this patent is extended or adjusted under 35 U.S.C. 154(b) by 177 days.

(21) Appl. No.: 17/599,797

(22) PCT Filed: Apr. 1, 2020

(86) PCT No.: PCT/US2020/026066

§ 371 (c)(1),
(2) Date: Sep. 29, 2021

(87) PCT Pub. No.: WO2020/205907

PCT Pub. Date: Oct. 8, 2020

(65) Prior Publication Data

US 2022/0195672 A1 Jun. 23, 2022

Related U.S. Application Data

(60) Provisional application No. 62/828,009, filed on Apr. 2, 2019.

(30) Foreign Application Priority Data

May 29, 2019 (FI) ..... 20195452

(51) Int. Cl.

| | |
|---|---|
| ***D21H 21/20*** | (2006.01) |
| ***D21H 17/55*** | (2006.01) |
| ***D21H 17/66*** | (2006.01) |
| ***D21H 17/69*** | (2006.01) |
| ***D21H 17/00*** | (2006.01) |
| ***D21H 23/50*** | (2006.01) |

(52) U.S. Cl.
CPC ..... *D21H 21/20* (2013.01); *D21H 17/55* (2013.01); *D21H 17/66* (2013.01); *D21H 17/69* (2013.01); *D21H 17/74* (2013.01); *D21H 23/50* (2013.01)

(58) Field of Classification Search
CPC ..... D21H 21/20; D21H 17/55; D21H 17/66; D21H 17/69; D21H 17/74; D21H 23/50
USPC ..... 162/164.6
See application file for complete search history.

(56) References Cited

U.S. PATENT DOCUMENTS

| | | | | |
|---|---|---|---|---|
| 5,362,573 | A | 11/1994 | Pandian et al. | |
| 6,034,181 | A * | 3/2000 | Bazaj | D21H 17/37 525/218 |
| 6,281,291 | B1 | 8/2001 | Bazaj et al. | |
| 2005/0245669 | A1 | 11/2005 | Clungeon et al. | |
| 2011/0247775 | A1 | 10/2011 | Sutman et al. | |
| 2012/0255696 | A1 | 10/2012 | Ballinger | |
| 2013/0284388 | A1 | 10/2013 | Ballinger | |

FOREIGN PATENT DOCUMENTS

| | | | |
|---|---|---|---|
| CN | 1194018 | A | 9/1998 |
| CN | 101133212 | A | 2/2008 |
| CN | 102383338 | A | 3/2012 |
| CN | 103255678 | A | 8/2013 |
| CN | 103614944 | A | 3/2014 |
| CN | 104153250 | A | 11/2014 |
| JP | H0299695 | A | 4/1990 |
| WO | 9708384 | A1 | 3/1997 |
| WO | 2006049547 | A1 | 5/2006 |
| WO | 2010133762 | A1 | 11/2010 |
| WO | 2011127268 | A8 | 10/2011 |
| WO | 2015075318 | A1 | 5/2015 |
| WO | 2016085836 | A1 | 6/2016 |
| WO | 2017192281 | A1 | 4/2017 |

OTHER PUBLICATIONS

An Yuqin et al., Pulping and Papermaking Additives, Professional textbooks of Colleges and Universities, ISBN 978-7-5019-3925-1, p. 183.
International Search Report and Written Opinion dated Jul. 10, 2020 in PCT/US2020/026066 (12 pages).
Finnish Patent Search Report dated Jan. 29, 2020 in FI Patent Application No. 20195452 (2 pages).

* cited by examiner

*Primary Examiner* — Mark Halpern
(74) *Attorney, Agent, or Firm* — Meunier Carlin & Curfman LLC

(57) ABSTRACT

Methods for making paper with improved strength and methods for improving paper strength, using a metal chelate and an organic polymer, and improved strength paper made through these processes.

15 Claims, 1 Drawing Sheet

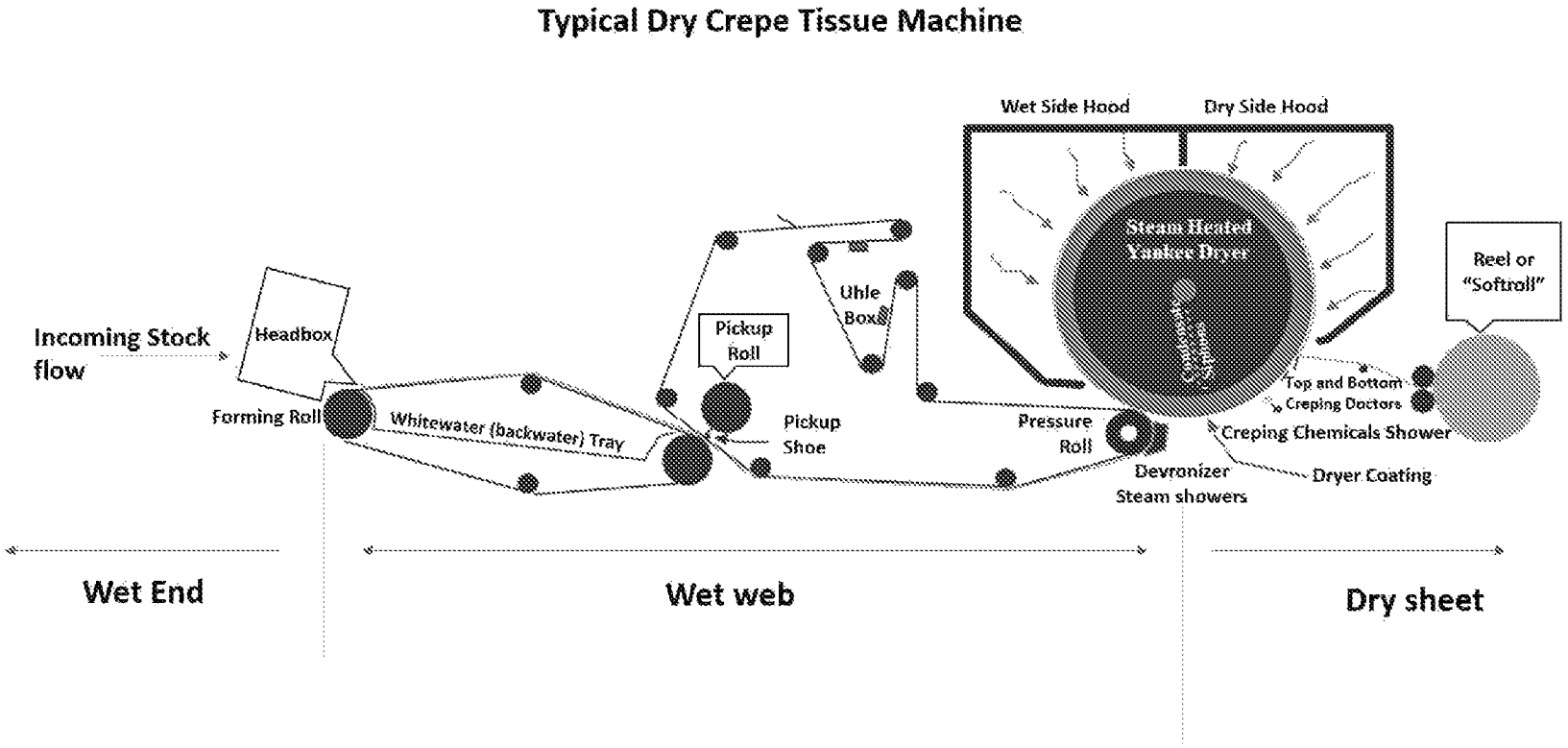
Typical Dry Crepe Tissue Machine
Reel or "Softroll"
Dry Side Hood
Wet Side Hood
Steam Heated Yankee Dryer
Top and Bottom Creping Doctors
Creping Chemicals Shower
Dryer Coating
Devronizer
Steam showers
Pressure Roll
Uhle Box
Pickup Roll
Pickup Shoe
Whitewater (backwater) Tray
Headbox
Forming Roll
Incoming Stock flow
Dry sheet
Wet web
Wet End

PAPER STRENGTH IMPROVEMENT USING METAL CHELATES AND SYNTHETIC CATIONIC POLYMERS

CROSS REFERENCE TO RELATED APPLICATIONS

This application is a United States National Phase Patent Application of International Patent Application Number PCT/US2020/026066, filed on Apr. 1, 2020, which claims the benefit of priority to U.S. Provisional Application No. 62/828,009, filed on Apr. 2, 2019, and Finnish National Application No. 20195452, filed on May 29, 2019, the contents of which are incorporated by reference herein in their entireties.

FIELD OF THE INVENTION

This invention relates to, paper with improved strength, methods for making paper with improved strength and methods for improving paper strength, using a metal chelate and at least one organic synthetic polymer.

BACKGROUND OF THE INVENTION

Various chemicals and fiber treatment concepts have been developed to meet the specific strength requirements in each case. While some of the individual chemicals and fiber treatment concepts have proven to provide targeted paper strength specifications, many of them perform well only when used for certain fiber stocks and/or under limited process conditions, and only satisfactorily or not at all for other fiber stocks or process conditions. Some of the strength providing chemicals and fiber treatment concepts have also been found to affect negatively in other aspects, such as harming rate of dewatering on wire or at press section, causing deposits, disturbing zeta potential of the fiber suspension etc.

Typically, strength increasing polymers are added to fiber stock during paper making process. Strength polymers are typically added in relatively high dosages to achieve desired strength level, so when using cationic strength polymers there is risk of over-cationizing the fiber stock which may cause problems such as excessive foaming, whereas anionic strength polymers, such as anionic polyacrylamide, carboxymethyl cellulose are known to slow down dewatering. Common strength polymers are negatively affected by harsh process conditions, especially by increased conductivity, alkalinity, pH, sulfites, oxidizing chemistry. Generally improvement of wet tensile in overwhelming majority of cases is achieved by PAE and there are very few alternative chemistries available for wet tensile improvement.

Furthermore, it is difficult to achieve controlled paper strength improvement through addition of strength polymers to the fiber stock. Also, softness of paper decreases substantially with increase in paper strength through addition of high dosages of strength polymers to the fiber stock.

Due to the increased environmental awareness and regulations, papermaking processes have become more and more closed using less fresh water, resulting in increased conductivity or total ionic strength, i.e. salt concentration, in the fiber suspension. Concurrently, the recycle fiber content has increased as a fiber source in the papermaking. The fibers obtained from the recycled fiber material may have undergone several rounds of recycling, which deteriorates the intrinsic strength of the fiber and general quality such as fiber length, thereby deteriorating end use properties of the paper, particularly the strength. Reduced intrinsic strength can increase risk of paper web breakages, negatively impacting productivity and overall process efficiency. One common measure to compensate strength loss is to increase the refining level of the fiber material. The goal of increasing the refining is to 'develop' by increasing the functional area exposing more carboxyl groups, thereby increasing the fibers ability to create more hydrogen bonds with other cellulosic fibers and cellulosic fines and subsequently increasing the strength. This operation results in a decrease in Canadian Standard Freeness (CSF) which is a measure of pulp drainage. Lower CSF slows down the drainage rate, and the weak recycled fibers have a limited response to the additional refining. The fiber length of recycled fiber will decrease sharply after a limited amount of refining, resulting in a reduction of various strength properties.

In addition to low quality fibers, recycled fiber materials may introduce significant levels of detrimental substances to the papermaking process. This can include ash originating from coating pigments, starch, sizing agents, dissolved and colloidal substances. These substances carried over to the papermaking process may further increase the overall colloidal load and conductivity of the fiber suspension, accumulating in the process water circuit. These materials can cause plugging and deposits on the equipment and produced paper.

It has been observed that the performance of conventional polymer additives decreases when used in fiber suspensions having elevated conductivity and dissolved and colloidal substances. The loss of polymer performance may lead to decreases in strength, drainage, retention of fiber and fiber fines, and press dewatering, which may increase web breakages, yield and drying demand of the paper, limiting paper machine productivity. While this kind of fiber suspensions and conditions would require higher dosages of the polymer additives to achieve desired performance, increasing the dosage does not fully address the issue. Dosage of high molecular weight polymers cannot be increased infinitely without eventually over-flocculating the fiber suspension which reduces press dewatering rates and causes poor formation, reducing productivity and strength, respectively. Increasing dosage of cationic polymers may lead into over-cationizing the fiber stock causing e.g. excessive foaming.

There is a need for new ways of making paper to provide maintained or improved paper attributes such as strength, while maintaining or improving the operation of the paper machine. It is also desirable to provide more environmentally friendly ways for production of paper.

There is a need to minimize the problems raised above and improve the overall production of papers. Consequently, more cost-effective, easy-to-handle and flexible strength additives and systems are still highly desired by many paper producers.

SUMMARY OF THE INVENTION

It is an object of the present invention to provide solutions to the problems encountered in the prior art.

It is an object of this invention to decrease or even avoid drawbacks of conventional strength polymers.

It is an object of the current invention to provide a method to improve paper strength, comprising adding a metal chelate during a paper making process.

It is an object of this invention to provide a method to improve paper strength, comprising adding a metal chelate and at least one synthetic organic polymer during a paper making process.

An object of the current invention is to provide a paper product with improved strength, made with a method comprising a metal chelate during a paper making process.

An object of the current invention is to provide a paper product with improved strength, comprising adding a metal chelate and at least one synthetic organic polymer during a paper making process.

Yet another object of the current invention is to provide a method to improve paper strength without substantially decreasing paper softness.

It is an object of this invention to provide a method to improve paper strength, comprising adding a metal chelate to a paper process wet end stock and/or a paper machine wet web and/or a dry sheet, during a paper making process.

It is an object of this invention to provide a method to improve paper strength, comprising adding a metal chelate and an organic synthetic polymer to a paper process wet end stock and/or a paper machine wet web and/or a dry sheet, during a paper making process.

Using methods and products of the current disclosure, it is possible to improve several strength related attributes of the paper, not just machine direction tensile strength that is relatively easy to contribute but at least one other strength attribute such as wet tensile, cross direction tensile strength, burst, Concora, ring crush, STFI, wet/dry, decay etc. which are more challenging to improve.

BRIEF DESCRIPTION OF THE DRAWINGS

The following drawing forms part of the present specification and is included to further demonstrate certain aspects of the present invention. The invention may be better understood by reference to the drawing in combination with the detailed description of the specification embodiments presented herein.

FIG. 1. Schematic diagram of tissue paper making process.

DETAILED DESCRIPTION OF THE INVENTION

The present disclosure is directed to, methods for improving paper strength and methods for producing paper with improved strength comprising adding a metal chelate, preferably zirconium or titanium metal chelate, and at least one synthetic organic polymer, during a paper making process, and improved strength paper made by the methods disclosed herein.

During a typical papermaking process, a cellulosic fiber suspension having relatively high consistency, the so-called thick stock, is diluted with white water or other circulating waters into thin stock. Typically, a fiber suspension having a consistency of above 20 g/l is called thick stock, before it is diluted with white water into thin stock. Thin stock is then delivered to a headbox, drained on a moving screen (often referred to as a machine wire) to form a wet web or an individual ply thereof, optionally the individual ply is combined with other plies being formed simultaneously, wet web is then pressed and dried, in a press section and dryer section, respectively to form dry sheet. It is known to add chemical additives to the wet end fiber stock for increasing retention of the fibers and other substances such as filler, and also for improving the dewatering rate on the machine wire and in the press section.

The wet end fiber stock may comprise cellulosic fibers, non-cellulosic fibers, or any combination thereof. By cellulosic fibers are meant any cellulosic or lignocellulosic fibers separated e.g. from wood, including softwood (SW) and hardwood (HW), bamboo, cotton, flax, hemp, jute, ramie, kenaf, abaca, or sisal, or fibers comprising regenerated cellulose such as rayon, lyocell, viscose. Typically the wet end fiber stock comprises cellulosic fibers obtained by chemical pulping such as Kraft pulping or sulphite pulping, mechanical pulping such as thermomechanical pulping (TMP), pressurized groundwood pulping (PGW), alkaline peroxide mechanical pulping (APMP), stone groundwood pulping (SGW), or refiner mechanical pulping (RMP), semi-chemical pulping such as chemithermo-mechanical pulping (CTMP), or organosolv pulping. The wet end fiber stock may comprise bleached or unbleached cellulosic fibers. In certain embodiments the wet end fiber stock comprises virgin fibers. In certain embodiments the wet end fiber stock comprises recycled fiber material, preferably in an amount of at least 50 weight-%, more preferably at least 80 weight-%, based on the fibers in the wet end stock (dry/dry). In certain further embodiments the recycled fiber material comprises old corrugated cardboard, mixed office waste, double liner kraft, waste activated sludge (WAS); reclaimed fiber sludge, or any mixtures thereof. By old corrugated cardboard (OCC) is meant a material comprising corrugated containers having liners of test liner, jute or kraft, and it may cover also double sorted corrugated cardboard (DS OCC). By mixed office waste (MOW) is meant a material mainly containing xerographic papers and offset papers. By double lined kraft is meant a material comprising clean sorted unprinted corrugated cardboard cartons, boxes, sheet or trimmings, e.g. of kraft or jute liner. In addition to cellulosic fibers, the wet end fiber stock may also comprise non-cellulosic polymeric fibers, such as fibers of polyethylene, polypropylene, or polyester, in the form of e.g. single component or bicomponent fibers. In some embodiments the wet end fiber stock may comprise at least 80 weight-%, at least 90 weight-%, or at least 95 weight-%, of non-cellulosic polymeric fibers, based on dry weight of the wet end fiber stock.

The term paper is understood to include a sheet material that contains fibers, and which may also contain other materials. Suitable fiber materials to be used in the present process include those described above, or any combinations thereof. As used herein, the terms fiber web and paper web are understood to include both forming and formed paper sheet materials. The term paper includes paper, paperboard or like. Terms paper, paperboard, paper product and paperboard product are used interchangeably herein.

The methods of the present disclosure are suitable for manufacture of improved strength simple fiber webs of single ply and multiple fiber webs such as paperboard products. Depending on the application, the number of fibrous substrates in a paper or paperboard product can vary. The paper product can be one ply- or multiply-product. The paper product can have more than one fibrous layer. In one embodiment, the paper product has two or more fibrous layers. Each of the plies of a multi-ply product or each of the layers of a multi-layer product may have different properties and may be formed from wet end fiber stocks having different types and amounts of fiber materials, and properties such as conductivities, anionic trash contents.

The methods of the present disclosure may be used for manufacture of improved strength papers of various paper grades such as, but not limited to, towel paper, tissue paper for example bath tissue paper, toilet paper, napkin, facial paper, multilayer board, kraft paper, liner/box board, medium, test liner, fluting, sack paper, white lined chipboard, gypsum board facing paper, coated recycled board, core board or folding boxboard.

Certain embodiments are directed to methods for improving paper strength, comprising adding a metal chelate to a paper process wet end stock and/or a paper machine wet web and/or a dry sheet, during a paper making process.

Certain embodiments are directed to methods for producing paper with improved strength, comprising adding a metal chelate to a paper process wet end stock and/or a paper machine wet web and/or a dry sheet, during a paper making process.

Certain embodiments are directed to paper products with improved strength, made with a method comprising adding a metal chelate to a paper process wet end stock and/or a paper machine wet web and/or a dry sheet, during a paper making process.

Certain embodiments are directed to methods for improving paper strength, comprising adding a metal chelate and an organic polymer to a paper process wet end stock and/or a paper machine wet web and/or a dry sheet, during a paper making process.

Certain embodiments are directed to methods for producing paper with improved strength, comprising adding a metal chelate and an organic polymer to a paper process wet end stock and/or a paper machine wet web and/or a dry sheet, during a paper making process.

Certain embodiments are directed to paper products with improved strength, made with a method comprising adding a metal chelate and an organic polymer to a paper process wet end stock and/or a paper machine wet web and/or a dry sheet, during a paper making process.

Paper process wet end stock or wet end stock refers to thick stock or thin stock or both. Terms paper process wet end stock, wet end stock, and fiber stock are used interchangeably herein. Terms paper machine wet web, and wet web are used interchangeably herein.

Addition of metal chelate to the paper process wet end stock includes addition of metal chelate to thick stock and/or thin stock. Addition of metal chelate to paper machine wet web includes addition of metal chelate to wet web of paper and/or an individual ply thereof and/or between the plies to be combined. Addition of metal chelate to the dry sheet includes addition of metal chelate to the dry sheet formed during and/or after drying of the wet web. Addition of organic polymer to the paper process wet end stock includes addition of organic polymer to thick stock and/or thin stock. Addition of organic polymer to paper machine wet web includes addition of organic polymer to wet web of paper and/or an individual ply thereof and/or between the plies to be combined. Addition of organic polymer to the dry sheet includes addition of organic polymer to the dry sheet formed during and/or after drying of the wet web.

Conventional strength polymers are known to be negatively affected by harsh process conditions like increased fiber stock conductivity that is typical as paper mills are having more and more closed water circulations, less fresh water added to process, due to increased environmental awareness and regulations. The concepts of the current disclosure using a metal chelate in combination with an organic polymer may be more resistant towards the negative effects of harsh process conditions like increased conductivity, even when added to wet end stock, potentially due to instant reactivity of the chelate and organic polymer and increase in polymer molecular weight and structure, especially when the polymer and the metal chelate are added as a mixture, or separately but simultaneously.

Harsh process conditions have less impact on strength polymer performance when the strength polymers are added to the wet web or dry sheet.

In certain embodiments the metal chelate is chelate of zirconium or titanium, preferably of zirconium.

In certain embodiments the metal chelate is selected from the group consisting of zirconium acetate, ammonium zirconium carbonate, potassium zirconium carbonate, zirconium oxychloride, zirconium hydroxychloride, zirconium orthosulphate and zirconium propionate and any combinations thereof; preferably zirconium acetate, ammonium zirconium carbonate, and potassium zirconium carbonate, and any combinations thereof.

Without wishing to be bound by any theory it is believed that metal chelates, especially zirconium chelates, can react with hydroxyl, amine, carboxyl, carbonyl and/or aldehyde groups of organic polymers and increase insolubility, molecular weight, viscosity and reduce adhesion of the organic polymers via crosslinking, intra- and inter polymer structuring. Metal chelates, especially zirconium chelates, can react with hydroxyl, amine, carboxyl, carbonyl and/or aldehyde groups that are abundant on the paper making fiber surfaces and/or that are present in the chemical additives or fines present in the wet-end stock or white water, and thereby induce crosslinking and increased bonding between the fibers and the other components present. Increased bonding between the fibers lead to improved paper strength. Metal chelates, especially zirconium chelates, are economic for use, easily available and easy to handle and pump due to their low solution viscosity.

In certain embodiments metal chelate is sprayed on the paper process wet end stock and/or the paper machine wet web and/or the dry sheet. In certain other embodiments metal chelate is added with a paper making machine. In certain embodiments metal chelate is added with a paper making machine used for drying, printing, or embossing application. In certain embodiments metal chelate is added with a spray on the sheet, dryer such as yankee dryer, a gravure roll, an ink jet or a printing press.

In certain embodiments organic polymer is sprayed on the paper process wet end stock and/or the paper machine wet web and/or the dry sheet. In certain other embodiments organic polymer is added with a paper making machine. In certain embodiments organic polymer is added with a paper making machine used for drying, surface sizing, printing or embossing application. In certain embodiments organic polymer is added with a spray on the sheet, dryer such as yankee dryer, size press, a gravure roll, an ink jet or a printing press.

In certain embodiments the metal chelate is added in an amount 0.05-20 lb/ton, preferably 0.1-10 lb/ton, more preferably 3-5 lb/ton based on dry weight of cellulosic fiber in the wet-end stock.

Organic polymer used in the current disclosure may comprise hydroxyl, amine, carbonyl and/or aldehyde functional groups. Without wishing to be bound by any theory it is believed that the metal chelate can interact with these functional groups of the polymer and increases intra- and inter-polymer structuring and molecular weight of the organic polymer by creating connections within and between the polymer chains. Increasing molecular weight of the polymer typically improves its strengthening effect on fiber-to-fiber bonds. The interaction between the metal chelate and the organic polymer may also increase organic polymer's insolubility in water, increase organic polymer's hydrophobic nature in aqueous environment, and increase solution viscosity of the organic polymer.

In certain embodiments the organic polymer comprises a permanent wet strength (PWS) polymer, such as polyamidoamine epichlorohydrin or poly(epichlorohydin-co-bis (hexamethylene)triamine). Permanent wet strength polymers are traditionally used in paper making process for wet strength improvement purposes. Here, a metal chelate and a permanent wet strength polymer are found to improve one or more strength parameters, compared to adding the permanent wet strength polymer alone, or if added as mixture, compared to adding the polymer and the metal chelate sequentially, at equal dosage.

In certain embodiments the organic polymer comprises a non-wet strength polymer (NWS). As used herein, by NWS polymer is meant organic polymers that may or may not provide or boost dry strength, but that do not provide wet strength. Examples of NWS include non-wet strength PAE, polyvinylamine (PVAM) such as partially and fully hydrolyzed poly-N-vinylformamide, net cationic polyacrylamide, net anionic polyacrylamide having weight average molecular weight <2 MDa, cationic starch, carboxymethyl cellulose (CMC), poly(dimethylamine(co)epichlorohydrin), or poly-(dimethylamine-co-epichlorohydrin-co-ethylenediamine). In these embodiments adding the NWS cationic synthetic polymer in combination with the metal chelate is found to provide improved wet strength, or even permanent wet strength, compared to using the NWS cationic synthetic polymer alone. In certain embodiments the NWS cationic synthetic polymer and metal chelate are added separately but simultaneously, or as mixed, thereby enhancing their interaction with each other.

In certain embodiments the organic polymer comprises a temporary wet-strength polymer (TWS). TWS polymers are traditionally used in paper making where permanent wet strength is not required or desired for the manufactured paper grade, e.g. when manufacturing flushable or repulpable papers (e.g. tissue paper). As used herein, by TWS polymer is meant strength polymers that provide wet strength, but do not provide permanent wet strength. Examples of TWS polymers include aldehyde-functionalized polymers such as aldehyde-functionalized polyacrylamides, aldehyde-functionalized starch-based or cellulose-based polymers, especially glyoxalated polyacrylamides or dialdehyde starch. In these embodiments adding the TWS cationic synthetic polymer in combination with the metal chelate is found to provide improved wet strength, or sometimes even permanent wet strength, compared to using the TWS polymer alone. These embodiments may reduce or even eliminate the need of conventional permanent wet strength resins like PAE. This is highly desired, as said permanent wet strength PAE has the drawback of forming deposits on paper machine, plugging felts, and hindering repulpability of papers containing it. In certain embodiments the TWS polymer and metal chelate are added separately but simultaneously, or as mixed, thereby enhancing their interaction with each other.

Also other organic polymers are traditionally used in paper making process for purposes other than strength improvement, for example as fixative, for flocculation, dewatering, retention etc.

Generally, organic polymers having net cationic or net anionic charge at pH 7 are preferred as being capable of forming ionic bonds with other components present in the wet end fiber stock, wet web or dry sheet having groups with opposite charge, as this is believed to provide improved effect on paper strength characteristics.

In certain embodiments one or more of the organic polymers has net cationic charge at pH 7, providing the benefit of self-retaining on cellulosic fibers typically having slightly anionic charge. Examples of organic polymers having net cationic charge at pH 7 include poly-(dimethylamine (co)epichlorohydrin), poly(dimethylamine-co-epichlorohydrin-co-ehylenediamine), poly(epichlorohydin-co-bis (hexamethylene)triamine), polyvinylamines (PVAM) such as partially and fully hydrolyzed poly-N-vinylformamide, polyethylene imine (PEI), homopolymers of cationic monomers such as diallyldimethylammonium chloride (DADMAC), copolymers of cationic monomers and non-ionic monomers, net cationic copolymers comprising cationic and anionic monomers, non-wet strength grade polyamidoamine-epichlorohydrin (having epichlorohydrin: amine molar ratio of less than 0.50), and cationic reactive strength polymers such as wet strength grade polyamidoamine-epichlorohydrin (having epichlorohydrin:amine molar ratio of at least 0.80), and cationic glyoxalated polymers such as cationic glyoxalated polyacrylamides. In certain embodiment the organic polymer comprises a net cationic polymer having a charge density of >0-5 meq/g, at pH 7. Net cationic organic polymers are especially preferred, not just due to self-retaining on fibers, but also as being capable of trapping and retaining anionic trash on the fibers.

In certain embodiments the organic polymer may have net neutral charge at pH 7.

In certain embodiments the organic polymer comprises a cellulose reactive strength polymer, i.e. polymer capable of reacting with cellulose. Examples of cellulose reactive strength polymers include wet strength grade polyamidoamine-epichlorohydrin (PAE), urea formaldehyde polymer (UF), melamine formaldehyde polymer (MF), and aldehyde-functionalized polymers like dialdehyde starch and glyoxalated polyacrylamides (GPAM). In certain embodiments the organic polymer comprises a cellulose non-reactive polymer. In these embodiments the metal chelate may provide reactivity to the polymer, especially when the organic polymer and the metal chelate are added as mixture.

In certain embodiments the organic polymer comprises a synthetic organic polymer. Synthetic polymers are often more homogenous and less vulnerable to microbiological degradation, and therefor may provide enhanced and more predictable strength performance compared to natural polymers like starch- or cellulose-based polymers.

In certain embodiments one or more of the organic polymers has an intrinsic viscosity (IV) of at least 0.5 dl/g, preferably at least 1 dl/g, more preferably at least 2 dl/g. IV reflects the molecular weight of the polymer. IVs are obtainable in a known manner by measuring average flow time with an Ubbelohde capillary viscometer (OC) for a series of dilutions having different polymer contents in aqueous NaCl solution (1 N), at 25° C., calculating specific viscosity from corrected average flow time, dividing the specific viscosity by the concentration to obtain reduced viscosity for each dilution, plotting reduced viscosity as function of concentration, and reading the Y-axis intercept to give the IV.

In certain embodiments one or more of the organic polymers has low molecular weight, i.e. an intrinsic viscosity of less than 0.5 dl/g.

In certain embodiments one or more of the organic polymers has standard viscosity (SV) of 1-5 mPas. SV measured at low concentration is another parameter reflecting molecular weight of the polymer. SV values are determined using a 0.1 weight-% polymer solution in 1 molar NaCl at 25° C. The measurement is taken using a Brookfield viscometer with a UL adapter at 60 rpm when the SV is 10 mPas or less.

Below in Table 1 strength improving characteristics of various organic polymers are given to illustrate their strength and non-strength nature.

TABLE 1 shows some commercially seen effects, and characteristics, of various organic polymers (when used in papermaking without further reactive strength resin) capable of being applied in this invention.

| Chemistries | Charge at pH 7 | Effect on Retention/ drainage | Effect on wet strength | Effect on dry strength | strength type |
|---|---|---|---|---|---|
| Wet-strength PAE | cationic | minor | major (permanent) | minor | PWS |
| Non-wet-strength PAE | cationic | insignificant | minor | insignificant | NWS |
| GPAM | cationic | major | major (temporary) | major | TWS |
| PVAM | cationic | major | minor | minor | NWS |
| Net cationic polyacrylamide | cationic | major | insignificant | minor | NWS |
| PEI | cationic | major | minor | minor | NWS |
| cationic Starch | cationic | major | insignificant | major | NWS |
| CMC | anionic | insignificant | insignificant | major | NWS |
| Net Anionic polyacrylamide (Mw < 2 MDa) | anionic | insignificant | insignificant | major | NWS |
| poly-(dimethylamine(co)-epichlorohydrin), poly(dimethylamine-co-epichlorohydrin-co-ehylenediamine) | cationic | major | insignificant | minor | NWS |
| poly(epichloro-hydrin-co-bis(hexamethylene)-triamine) | cationic | | major (permanent) | minor | NWS |

In certain embodiments the organic synthetic polymer comprises one or more of polyvinylamine such as partially and fully hydrolyzed poly-N-vinylformamide, glyoxalated polyacrylamide (GPAM), polyacrylamide such as cationic polyacrylamide and non-ionic polyacrylamide, polyamidoamine, polyamidoamine-epichlorohydrin, polyamine-epichlorohydrin, polyamine-polyamidoamine-epichlorohydrin, polyacrylates, polyamines, polyamides, and polyesters; preferably one or more of polyvinylamine and glyoxalated polyacrylamide.

In certain embodiments the organic polymer is added in an amount 0.1-40 lb/ton, preferably 1-10 lb/ton, more preferably 2-8 lb/ton based on dry weight of cellulosic fiber in the wet end stock.

In certain embodiments the organic polymer and the metal chelate are added on wet web and/or on dry sheet, especially on dry sheet. In this way any adverse effect of harsh wet end conditions such as high conductivity, hardness, alkalinity, sulfite level etc. on the performance of the organic polymer and the metal chelate may be minimized.

In certain embodiments at least, the metal chelate is added on dry sheet. In this way it may be possible to achieve paper with improved strength without hurting absorbency. In certain embodiments both the metal chelate, and the organic polymer are added on dry sheet. In this way strength attributes of ready-made dry sheets may be contributed in different ways and converted into various end-products having different strength characteristics.

In certain embodiments a metal chelate having pH>7, preferably pH>8, is added on wet web and/or dry sheet, and an organic polymer comprising a temporary wet strength polymer is added to wet end stock, wet web and/or dry sheet. Examples of temporary wet strength polymers include aldehyde functionalized organic polymers, such as glyoxalated polyacrylamides, glyoxalated starch, and dialdehyde starch. In this way it may be possible to improve strength decay characteristics of the paper, desired e.g. for flushable tissues and towels.

In certain embodiments a metal chelate, and an organic polymer are mixed together and the metal chelate organic polymer mixture is added to a paper process wet end stock and/or a paper machine wet web and/or a dry sheet, during a paper making process. In these embodiments the interactions between the organic polymer and the metal chelate may be enhanced thereby providing further improved strengthening effect.

When selecting suitable mixture of the metal chelate and the synthetic polymer, the potential to provide strength performance is related to the increase in final viscosity of the mixture. Below is an example of increased viscosity when a metal chelate having viscosity less than 100 pc is added to a synthetic polymer concentrate. The increased viscosity is observed within an hour from mixing and preferably in less than 5 minutes from the mixing.

| | % metal chelate (<100 cps) added to polymer concentrate | | |
|---|---|---|---|
| Synthetic polymers | 0% | 1% | 4% |
| GPAM cpswet strength | 34 cps | 104 cps | 5150 cps |
| PAE non wet strength | 150 cps | 259 cps | 1620 cps |
| PAE | 40 cps | 20000 cps | 20000 cps |

Accordingly, in certain embodiments the viscosity of the metal chelate organic polymer mixture is between 1-20 000 cp, preferably between 1-10000 cp, most preferably—1-

5000 cp when measured within an hour and preferably within 5 minutes from the mixing. In certain embodiments, the viscosity of the mixture is greater than combined viscosity of the components.

In certain embodiments, the organic polymer and the metal chelate, are mixed at relatively high concentration to provide further enhanced interaction and polymer structuring and diluted thereafter to the desired use-concentration with dilution water and/or with feed water. Feed water is water used for feeding/pushing/mixing the additive to fiber stock in the process stream. In certain embodiments the metal chelate, and the organic polymer are first diluted to use-concentration and then mixed. In certain embodiments the metal chelate and the polymer may be diluted with water and added separately.

In certain embodiments, the metal chelate organic polymer mixture is added to a paper process wet end stock and/or a paper machine wet web and/or a dry sheet, within at most 1 minute, preferably between 30 seconds to 1 minute, of mixing the metal chelate and the organic polymer together. In certain embodiments the organic polymer is diluted to wt 1% as active solids and is mixed with a metal chelate, and the metal chelate organic polymer mixture is added to a paper process wet end stock and/or a paper machine wet web and/or a dry sheet, during a paper making process.

It was surprisingly found that, more increase in paper strength, especially in wet strength, and even in permanent wet strength, may be achieved by adding a metal chelate and an organic polymer separately but simultaneously, or especially as a mixture/pre-mixture, compared to sequential addition of the organic polymer and the metal chelate at equal dosage, during the paper making process. In certain embodiments the organic polymer and the metal chelate added separately but simultaneously, or especially as mixture/pre-mixture, may improve one or more strength parameters, compared to adding the organic polymer alone, or compared to adding the polymer and the metal chelate sequentially, at equal dosage. The mixtures are preferably generated on-site at paper mills by co-mixing the polymer with the metal chelate, for instant use in the papermaking, to maximize the efficiency and avoid stability issues such as precipitation or gelling which may appear over an extended storage time.

The mixture is to be forwarded to a paper process wet end stock or on a forming or formed wet fiber web or dry sheet within a reasonable time frame after co-mixing. In one embodiment the co-mixed mixture is introduced to the wet end stock or on the forming or formed wet fiber web or dry sheet at most 10 minutes after initiation of co-mixing, preferably at most 1 minute after initiation of co-mixing, most preferably between 30 seconds to 1 minute of co-mixing.

Such short mixing time is possible due to metal chelates' capability to interact quickly with available functional groups in the polymers. Such short times are also beneficial to maintain the mixture substantially free from precipitates or gelling. The time frame includes the combining as well as the transport to provide the co-mixed mixture to the paper making process. 30 seconds to 1 minute mixing time is preferred where the concentration of the organic polymer and metal chelate before mixing is independently above 20 wt-%. 30 seconds allows enough time for the metal chelates to induce crosslinking between the polymer chains and gelling does not occur in 1 minute. Gelling can be prevented for longer time if the concentration of the metal chelate and organic polymer is lowered. With concentration of the metal chelate and organic polymer independently before mixing 1%, gelling can be avoided till 10 minutes of mixing.

The co-mixing embodiment provides a further benefit that no additional storage tank is needed for keeping the mixture. The mixing can even be conducted by feeding the polymer and the metal chelate via a common pipeline to the paper making process and adjusting the contact time with pipeline length.

In certain embodiments a metal chelate and an organic polymer is added to a paper process wet end stock and/or a paper machine wet web and/or a dry sheet, during a paper making process, separately.

In certain embodiments a metal chelate and an organic polymer is added to a paper process wet end stock and/or a paper machine wet web and/or a dry sheet, during a paper making process, separately but simultaneously.

In certain embodiments a metal chelate and an organic polymer is added to a paper process wet end stock and/or a paper machine wet web and/or a dry sheet, during a paper making process, separately but essentially at same time and same location of the paper making process. By separately but essentially at the same time and same location it is meant that metal chelate and organic polymer are added through separate injection pipes that come together at same location. Adding at same location refers to adding along a same ring circle of the paper making process central pipe and/or adding along a same orthogonal plane of the paper making process central pipe.

In certain embodiments a metal chelate and an organic polymer is added to a paper process wet end stock and/or a paper machine wet web and/or a dry sheet, during a paper making process, sequentially wherein the metal chelate is added after the organic polymer.

In certain embodiments an organic polymer and a metal chelate is added to a paper process wet end stock, during a paper making process. In certain embodiments an organic polymer is added to a paper process wet end stock and a metal chelate is added to a paper machine wet web, during a paper making process. In certain embodiments an organic polymer is added to a paper process wet end stock and a metal chelate is added to a dry sheet, during a paper making process. In certain embodiments an organic polymer is added to a paper process wet end stock and a metal chelate is added to a paper machine wet web and dry sheet, during a paper making process. In certain embodiments an organic polymer and a metal chelate is added to a paper machine wet web, during a paper making process. In certain embodiments an organic polymer is added to a paper machine wet web and a metal chelate is added to a dry sheet, during a paper making process. In certain embodiments an organic polymer and a metal chelate is added to a dry sheet, during a paper making process. In certain embodiments an organic polymer is added to a paper process wet end stock and paper machine wet web and a metal chelate is added to a paper machine wet web and a dry sheet, during a paper making process.

In certain embodiments wet tensile and/or immediate wet tensile and/or permanent wet tensile and/or dry tensile and/or burst and/or STFI and/or stiffness and/or mullen and/or internal bonding and/or ply bonding and/or ring crush and/or wax pick and/or ink test and/or IGT and/or decay of the paper improves or increases due to the addition of the metal chelate and the organic polymer during the paper making process. The improvement or increase (or decrease or decay) is measured with respect to a paper produced with a similar paper making process expect the metal chelate and the organic polymer are not added during the similar process.

In certain embodiments wet/dry ratio of the paper improves by at least 2 point % due to the addition of the metal chelate or the metal chelate and the organic polymer. In certain embodiment the paper is tissue paper, e.g. toilet paper, napkin or facial paper. With increase of wet/dry ratio paper wet strength increases without comparable increase in paper hardness.

In certain embodiment, the paper strength is selectively increased in one or more areas of the paper, wherein the metal chelate or the metal chelate and the organic polymer is sprayed selectively on one or more areas of the dry sheet, where the paper strength needs to be increased.

In certain embodiments, the paper is a towel paper and addition of the metal chelate and permanent wet strength polymer increases permanent wet tensile at least 5%, preferably at least 10%.

In certain embodiments, the paper is a bath tissue paper and addition of the metal chelate and non-wet strength polymer increases wet tensile at least 5%, preferably at least 10% and decay at least 50%, more preferably 60% and most preferably 70%.

In certain embodiments, the paper is a multilayer board or liner/box board and addition of the metal chelate or the metal chelate, and the organic polymer increases ring crush at least 5% preferably 10%, and/or STFI at least 5%, preferably 10%, and/or burst strength at least 10%, preferably 15%.

In certain embodiments, a multi-layered fibrous web is manufactured from wet webs formed by multiple separate forming units, wherein each of the wet web, is formed from a fiber stock by using own forming unit and at least part of water is drained on a wire section, and the formed wet webs are joined together and the joined wet webs are subjected to further draining, wet-pressing and drying for obtaining the multi-layered fibrous web product. In certain embodiments before the wet webs are joined, a metal chelate is added to at least one surface of at least one wet web being joined. In certain embodiments before the wet webs are joined, a metal chelate and organic polymer, separately or simultaneous, are added to at least one surface of at least one wet web being joined. In certain embodiments before the wet webs are joined, a metal chelate and organic polymer pre-mixture is added to at least one surface of at least one wet web being joined. The forming unit refers to any arrangement which may be used to form wet web from fiber stock, and with which arrangement separate wet webs are first formed on the wire or the like and in the later stage the separate at least partly drained wet webs are joined to multi-layered fibrous web. The forming unit may comprise a head box or a cylinder former.

According to an embodiment a multi-layered fibrous web product or one or more layers of the multi-layered fibrous web product may be formed by using multilayer headbox. According to an embodiment of the invention, one or more layers of the multi-layered fibrous web product may also be formed by using forming units so that at least fibrous layer is a lip flow of headbox or a jet of headbox. Therefore, one layer of the multi-layered fibrous web may be manufactured from wet web formed by forming unit, wherein wet web is formed from a fiber stock and at least part of water is drained on a wire section from it, and then another wet web is applied on the surface of the at least partly drained wet web and the joined fibrous layers are subjected to further draining, wet-pressing and drying for obtaining the multi-layered fibrous web product. Another wet web applied on the surface of the first web is not necessarily subjected to the draining prior to joining. In an embodiment according to the invention, the combined multi-layered web is subjected to vacuum watering phase prior to wet-pressing. The multi-layered fibrous web may also be manufactured by joining wet webs or dry sheets by gluing or by laminating.

In certain embodiments the organic polymer does not comprise starch.

In certain embodiments, still further papermaking additives such as further strength agents and/or flocculants, as well as retention aids, drainage aids, biocides, defoamers, brightening agents, colours, sizing agents, fixatives, coagulants, or any combinations thereof, may be added to the wet end fiber stock at any time before the headbox.

Any embodiment discussed with respect to one aspect of the invention applies to other aspects of the invention as well and vice versa. Each embodiment described herein is understood to be embodiments of the invention that are applicable to all aspects of the invention. It is contemplated that any embodiment discussed herein can be implemented with respect to any method or composition of the invention, and vice versa. Furthermore, compositions and kits of the invention can be used to achieve methods of the invention.

The use of the word "a" or "an" when used in conjunction with the term "comprising" in the claims and/or the specification may mean "one," but it is also consistent with the meaning of "one or more," "at least one," and "one or more than one."

Throughout this document, the term "about" is used to indicate that a value includes the standard deviation of error for the device or method being employed to determine the value.

The use of the term "or" in the claims is used to mean "and/or" unless explicitly indicated to refer to alternatives only or the alternatives are mutually exclusive, although the disclosure supports a definition that refers to only alternatives and "and/or."

As used in this disclosure, the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

EXAMPLES

The following examples as well as the figures are included to demonstrate preferred embodiments of the invention. It should be appreciated by those of skill in the art that the techniques disclosed in the examples or figures represent techniques discovered by the inventors to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention.

Procedures Used in the Examples

Hand Sheet Procedure

Hand sheet studies were conducted using the pulps specified in the examples. Prior to the hand sheet preparation, the thick stock was diluted to ~0.5% with machine white water for the recycled brown furnish or deionized water treated with 150 ppm sulfate ion and 35 ppm calcium ion for virgin furnish. The pH value of diluted stock was 6.8 to 7.0 during hand sheets making. In below examples 1-20 the basis weight of the hand sheets varied between 35 and 150 g/m$^2$.

Dynamic Sheet Former was used to prepare the hand sheets according to the standard protocol. Sheets were pressed at 15 psi (if needed) and drum dried for 60 seconds for 35 gsm sheet and 90 seconds for 150 gsm sheet. The sheets were post cured for 5 minutes at 105° C. if GPAM or PAE product was used. Prior to the paper physical testing, the paper sheets were conditioned at least overnight at 73° F. and 50% relative humidity. This follows the TAPPI T 402 om-93, Standard Conditioning and Testing Atmospheres for Paper, Board, Pulp hand sheet, and Related Products method.

Sheet Spraying

The first spraying system is 1550 AutoJet Modelar Spray System with Phoenix I single axis Servo controller. The spray was set for single pass with 87% on spraying on. That gave approximate 0.65-0.69 gram of wet pick up on a dry sheet and approximate 0.45 to 0.50 gram of wet pick on a wet web.

Examples 1-12 below illustrate effects of application of polyvinylamine as an exemplary synthetic organic non-wet strength polymer or cationic GPAM as exemplary temporary wet strength polymer, in combination with zirconium acetate as an example of metal chelate, on various addition points and paper characteristics. Examples 13-16 illustrate effects of application of metal chelate of which zirconium acetate is an example here, on various addition points and paper characteristic. Examples 17-20 illustrate effects of application of wet-strength polyamidoamine-epichlorohydrine (WS-PAE, having epichlorohydrin:amine molar ratio of at least 0.80) as an example of organic synthetic permanent wet strength polymer and non-wet strength polyamidoamine-epichlorohydrin (NWS-PAE, a light crosslinked PAE having epichlorohydrin:amine molar ratio of less than 0.50) as an example of organic synthetic dry strength booster and non-wet strength polymer, in combination with zirconium acetate as an example of metal chelate on various addition points and paper characteristics.

Addition of Organic Non-Wet Strength or Temporary Wet Strength Polymer and Metal Chelate at Various Points of Paper Making

Example 1. Sequential Application of Polyvinylamine at Wet End and Zirconium Acetate on Wet Web—Tissue and Towel Paper Grade Pulp used in this example was brown stock which was a blend furnish of 50% OCC and 50% MOW. The target basis weight was 35 gsm, typical for tissue and towel grades. Parallel experiments were run, in one experiment, polyvinylamine (8 lb/ton) was applied at the wet end, in another experiment zirconium acetate (5 lb/ton) was applied onto the wet web through 1550 AutoJet Modelar Spray System before drying, in another experiment polyvinylamine (8 lb/ton) was applied at the wet end and zirconium acetate (5 lb/ton) was applied onto the wet web through 1550 AutoJet Modelar Spray System before drying, in one experiment zirconium and polyvinylamine was not added. The approximate solid content of the wet web is about 15 to 30%. Lupamin 9050, having molecular weight of about 350 kDa and hydrolysis-% of about 50%, was used as the polyvinylamine (PVAM) in all experiments using PVAM.

Tables 2-5 below show the results. Addition of zirconium acetate and polyvinylamine increased immediate wet tensile by about 127% (Table 3) and permanent wet tensile—wet tensile after 10-minute soak by about 26% (Table 4), compared to polyvinylamine alone. As a result, wet strength decay increased from 34.8% (polyvinylamine only) to 63.7% (polyvinylamine and zirconium acetate), shown in Table 5 and wet/dry ratio changed from 19.2% (polyvinylamine only) to 45.5% (polyvinylamine and zirconium acetate), shown in Table 5. Additional Zirconium acetate with PVAM did not increase dry tensile in this case compared to PVAM only (shown in Table 2). The wet/dry ratio is calculated by immediate wet tensile divided by dry tensile. Unit gF/inch means gram force per inch.

TABLE 2

CD dry tensile results

| Wet end addition | no ZrAc gF/inch | 5# ZrAc gF/inch | DT increase |
|---|---|---|---|
| Blank | 1326 | 1318 | −0.61% |
| 8# PVAM | 1393 | 1342 | −3.66% |

TABLE 5

Wet/dry and 10 minutes decay results

| | 10 min Decay | | Wet/Dry | |
|---|---|---|---|---|
| | no ZrAc | 5# ZrAc | no ZrAc | 5# ZrAc |
| Blank | 34.1% | 27.4% | 6.3% | 8.9% |
| 8# PVAM | 34.8% | 63.7% | 19.2% | 45.5% |

TABLE 3

CD Immediate wet tensile results

| Wet end addition | no ZrAc gF/inch | 5# ZrAc gF/inch | IWT increase |
|---|---|---|---|
| Blank | 83.9 | 117.2 | 39.7% |
| 8# PVAM | 267.6 | 609.9 | 127.9% |

TABLE 4

CD wet tensile after 10 minutes soak

| | no ZrAc gF/inch | 5# ZrAc gF/inch | 10 m soak increase |
|---|---|---|---|
| Blank | 55.3 | 85.1 | 53.9% |
| 8# PVAM | 174.4 | 221.3 | 26.9% |

Example 2 Polyvinylamine and Zirconium Acetate Application Sequentially or as a Mixture at Wet End—Printing and Writing Paper Grade Pulp used in this example was virgin bleached fiber with 50% SW and 50% HW. The target basis weight was 75 gsm, typical for printing and writing grades. Parallel experiments were run. In one, 5 lb/ton zirconium acetate was added to the wet end. In another, 1% polyvinylamine was added to the wet end. In another, 1% polyvinylamine and 5 lb/ton zirconium acetate was added to the wet end sequentially. In another, 1% polyvinylamine was co mixed with 5 lb/ton zirconium acetate, and the polyvinylamine and zirconium acetate mixture was added to the wet end.

When zirconium acetate and polyvinylamine were added sequentially, there is very limited strength increase. Results in table 6 show that co-mixing zirconium acetate and polyvinylamine prior to the addition to the pulp slurry gave about 17% increase on both immediate weight tensile and permanent weight tensile—wet tensile after 30-minute soak and about 14% on dry tensile compared to 5 lb/ton of PVAM used alone. Table 6 also shows benefit of addition of zirconium acetate and polyvinylamine as a mixture, over sequential addition of zirconium acetate and polyvinylamine.

TABLE 6

| Polyvinylamine and zirconium acetate application sequentially (Seq) or as a mixture (CO-mix) at wet end | | | | | | |
|---|---|---|---|---|---|---|
| | CD DT lb/inch | CD IWT lb/inch | CD 30 min Soak lb/inch | DT improvement | IWT improvement | PWT improvement |
| 5# ZrAc | 8.95 | 0.529 | 0.366 | | | |
| 5# PVAM (1%) | 8.70 | 0.814 | 0.764 | | | |
| 0.4# ZrAc + 5# PVAM (Seq) | 8.93 | 0.788 | 0.770 | 2.6% | −3.2% | 0.8% |
| 0.4# ZrAc + 5# PVAM Co-mix | 9.88 | 0.952 | 0.896 | 13.5% | 17.0% | 17.3% |

Example 3 Polyvinylamine and Zirconium Acetate Applied on Dry Sheet as a Mixture—Printing and Writing Paper Grade Parallel experiments were conducted. In one experiment 5 lb/ton polyvinylamine was added on the dry sheet through lab scale flooded nip size press. In another experiment 5 lb/ton polyvinylamine was mixed with 0.4 lb/ton zirconium acetate, and the mixture was added on the dry sheet through lab scale flooded nip size press. The base sheet, in these experiments, were with PCC as the filler, typical for printing and writing grades.

Table 7 shows that addition of zirconium acetate with polyvinylamine as a mixture increases the permanent wet tensile by about 8% compared to addition of polyvinylamine only.

TABLE 7

| Polyvinylamine and zirconium acetate applied on dry sheet as a mixture - Size press results | |
|---|---|
| | 30 minutes soak (lb/inch) |
| 5#PVAM | 0.961 |
| 5#PVAM + 0.4#ZrAc | 1.035 |

Example 4 Polyvinylamine and Zirconium Acetate Applied Sequentially on Dry Sheet—Recycled White Towel Paper Parallel experiments were run. In one experiment, polyvinylamine (4 lb/ton) was sprayed on the dry sheet. In other experiment, first polyvinylamine (4 lb/ton) and then zirconium acetate (4.55 lb/ton) was sprayed on the dry sheet sequentially through 1550 AutoJet Modular Spray System then 3M ACCUSPRAY 16580. In still another, no polyvinylamine or zirconium was added. The base paper used is a commercial recycled white towel with 40 gsm basis weight. The dry sheet moisture was about 4%.

Sequential addition of polyvinylamine and zirconium acetate to the dry sheet increases permanent wet tensile—wet tensile after 10 minutes soak by about 21% (Table 8), compared to addition of polyvinylamine only to the dry sheet.

TABLE 8

| Polyvinylamine and zirconium acetate applied sequentially on dry sheet | | | |
|---|---|---|---|
| | DT (gF/inch) | IWT (gF/inch) | 10 m soak (gF/inch) |
| Control | 2335 | 242 | 147 |
| 4# PVAM only | 2554 | 323 | 235 |
| 4# PVAM + 4.55# ZrAc | 2534 | 327 | 283 |

Example 5 Polyvinylamine and Zirconium Acetate Applied Sequentially or as a Mixture on Dry Sheet—Recycled White Towel Parallel experiments were run. In one experiment first polyvinylamine (2 lb/ton) and then zirconium acetate (5.4 lb/ton) was sprayed to the dry sheet sequentially. In another experiment polyvinylamine (2 lb/ton) and zirconium acetate (3 lb/ton) were co-mixed and the mixture was added to the dry sheet. The base paper used is a commercial recycled white towel with 40 gsm basis weight. The dry sheet moisture was about 4%.

Table 9 shows that immediate wet tensile increases by about 22% and permanent wet tensile—wet tensile after 10 minutes increases by 26% by addition of polyvinylamine zirconium acetate mixture, compared to sequential addition of polyvinylamine and zirconium acetate.

TABLE 9

| PVAM and ZrAc applied sequentially (Seq) or as a mixture (comix) | | | |
|---|---|---|---|
| | DT (gF/inch) | IWT (gF/inch) | 10 m soak (gF/inch) |
| PVAM + ZrAc adding separately | 2638 | 294 | 230 |
| PVAM + ZrAc comix | 2569 | 359 | 290 |
| % increase | | 23 | 26 |

Example 6 Polyvinylamine Applied at Wet End and Zirconium Acetate or Ammonium Zirconium Carbonate Applied on Dry Sheet—Tissue and Towel Paper Grade Pulp used in this example was virgin bleached fiber with 50% SW and 50% HW. The target basis weight was 35 gsm, typical for tissue and towel grades. Parallel experiments were run. In one experiment, polyvinylamine (4 lb/ton) was added at the wet end. In another experiment, polyvinylamine (4 lb/ton) was added at the wet end and zirconium acetate (3.9 lb/ton) was sprayed onto the dry sheet through 1550 AutoJet Modular Spray System. In one experiment, polyvinylamine (4 lb/ton) was added at the wet end and ammonium zirconium carbonate (3.74 lb/ton) was sprayed onto the dry sheet through 1550 AutoJet Modular Spray System. Dry sheet moisture was approximately about 4 to 8%.

Immediate wet tensile increases by 18.5% and 21% by addition of zirconium acetate or ammonium zirconium carbonate respectively on dry sheet, with polyvinylamine application at wet end, compared to addition of polyvinylamine only (Table 10). Permanent wet tensile—wet tensile after 10 minutes soak increases by about 28% and about 19% by addition of zirconium acetate or ammonium zirconium carbonate respectively, with polyvinylamine application at wet end, compared to addition of polyvinylamine only (Table 10). The wet/dry ratio increases by 18%.

TABLE 10

Polyvinylamine applied at wet end and zirconium acetate or ammonium zirconium carbonate applied on dry sheet

| | DT (gF/inch) | DT increase | IWT (gF/inch) | IWT increase | 10 m soak (gF/inch) | 10 m soak increase |
|---|---|---|---|---|---|---|
| PVAM only | 3053 | | 139 | | 118 | |
| PVAM + ZrAc | 2950 | −3.4% | 165 | 18.5% | 151 | 28.2% |
| PVAM + AZC | 3031 | −0.7% | 168 | 21.0% | 141 | 19.3% |

Example 7 GPAM Applied at Wet End and Ammonium Zirconium Carbonate on Dry Sheet Pulp used in this example was virgin bleached fiber with 50% SW and 50% HW. The target basis weight was 35 gsm, typical for tissue and towel grades. Parallel experiments were run. In one experiment, cationic GPAM (4 lb/ton) was added at the wet end. In other experiment, cationic GPAM (4 lb/ton) was added at the wet end and ammonium zirconium carbonate (3.9 lb/ton) was sprayed onto the dry sheet through 1550 AutoJet Modular Spray System. Dry sheet moisture was approximately about 4 to 8%.

As is shown in Table 11, immediate wet tensile increases by 19% by addition of ammonium zirconium carbonate with GPAM, compared to addition of GPAM only. Permanent wet tensile—wet tensile after 10 minutes soak decrease 1.2% by addition of ammonium zirconium carbonate with GPAM, compared to addition of GPAM only.

The 10 minutes wet strength decay increased from 29% (GPAM only) to 410% (GPAM and ammonium zirconium carbonate). This is beneficial for fast decay towel.

The wet/dry ratio increases by 18%.

TABLE 11

GPAM at wet end and dry sheet spray zirconium

| | DT (gF/inch) | DT increase | IWT (gF/inch) | IWT increase | 10 m soak (gF/inch) | 10 m soak increase |
|---|---|---|---|---|---|---|
| GPAM only | 2795 | | 137 | | 98 | |
| GPAM3000 + AZC | 2812 | 0.6% | 164 | 19.1% | 97 | −1.2% |

Example 8 Polyvinylamine and Zirconium Acetate are Applied Sequentially on Dry Sheet—Tissue Paper Grade Pulp used in this example was virgin bleached fiber with 50% SW and 50% HW. The target basis weight was 35 gsm, typical for tissue and towel grades. Parallel experiments were run. In one experiment, polyvinylamine (4 lb/ton) was sprayed on to the dry sheet. In other, polyvinylamine (4 lb/ton) and then zirconium acetate (5.62 lb/ton) were sprayed on the dry sheet sequentially through 1550 AutoJet Modular Spray System then 3M ACCUSPRAY 16580. Dry sheet moisture was approximately about 4 to 8%.

Table 12 shows dry tensile, immediate wet tensile, and permanent wet tensile-wet tensile after 10 minute soak, increases by about 27%, 30% and 38% respectively with sequential addition of polyvinylamine and zirconium acetate on the dry sheet, compared to addition of polyvinylamine only on the dry sheet.

TABLE 12

PVAM and Zirconium on dry sheet sequentially

| | DT (gF/inch) | DT increase | IWT (gF/inch) | IWT increase | 10 m (gF/inch) | 10 m soak soak increase |
|---|---|---|---|---|---|---|
| PVAM only | 2487 | | 173 | | 158 | |
| PVAM + ZrAc | 3146 | 26.50% | 226 | 30.37% | 218 | 38.15% |

Example 9 Polyvinylamine and Zirconium Acetate Applied on Dry Sheet Sequentially—Packaging and Board Grades Pulp used in this example was virgin bleached fiber with 50% SW and 50%1 HW. The target basis weight was 150 gsm, typical for packaging and board grades. Parallel experiments were run. In one experiment, polyvinylamine (4 lb/ton) was sprayed on to the dry sheet. In other, polyvinylamine (4 lb/ton) and then zirconium acetate (3.8 lb/ton) were sprayed on the dry sheet sequentially through 1550 AutoJet Modular Spray System then 3M ACCUSPRAY 16580. In other, no zirconium and polyvinylamine was added. Dry sheet moisture was approximately about 4 to 8%.

Table 13 shows dry tensile, STFI, and burst, increases by 1%, 6% and 4% respectively with sequential addition of polyvinylamine and zirconium acetate on the dry sheet, compared to addition of polyvinylamine only on the dry sheet.

TABLE 13

Polyvinylamine and zirconium acetate applied on dry sheet sequentially

| | STFI (lb/inch) | DT (lb/inch) | Burst (PSI) |
|---|---|---|---|
| control | 9.40 | 9.61 | 69.53 |
| PVAM only | 9.85 | 10.45 | 77.50 |
| PVAM + ZrAc | 10.46 | 10.58 | 80.44 |

Example 10 Polyvinylamine Applied at Wet End and Zirconium Acetate on Dry Sheet—Packaging and Board Grade Pulp used in this example was virgin bleached fiber with 50% SW and 50% HW. The target basis weight was 150 gsm, typical for packaging and board grades. Parallel experiments were run. In one experiment, polyvinylamine (4 lb/ton) was added to wet end, with pulp slurry consistency 0.6%. In other, polyvinylamine (4 lb/ton) was added to wet end, with pulp slurry consistency 0.6% and zirconium acetate (3.6 lb/ton) was sprayed on the dry sheet through 1550 AutoJet Modular Spray System. In another, no polyvinylamine and zirconium was added. Dry sheet moisture was approximately about 4 to 8%.

Table 4 shows dry tensile, STFI, and burst, increases by 11%, 4% and 5% respectively with addition of polyvinylamine at the wet end and zirconium acetate on the dry sheet, compared to addition of polyvinylamine at the wet end only.

TABLE 14

PVAM applied at wet end and ZrAc dry sheet spray

| | STFI (lb/inch) | DT (lb/inch) | Burst (PSI) |
|---|---|---|---|
| control | 11.24 | 11.44 | 68.14 |
| PVAM only | 12.11 | 11.78 | 82.88 |
| PVAM + ZrAc | 12.56 | 13.02 | 86.77 |

Example 11 Polyvinyl Amine and Zirconium Acetate are Applied in Wet End as a Mixture-Packaging and Board Grade Paper Pulp used in this example was virgin bleached fiber with 50% SW and 50% HW. The target basis weight was 150 gsm, typical for packaging and board grades. Parallel experiments were run. In one, polyvinylamine (5 lb/ton) was mixed with zirconium acetate (0.4 lb/ton), and the polyvinylamine zirconium acetate mixture was added to the wet end. In another, polyvinylamine (5 lb/ton) was added to the wet end.

STFI, burst and internal bond (Table 15) increases by 6%, 5% and 7% respectively with addition of polyvinylamine zirconium acetate mixture at the wet end, compared to addition of polyvinylamine only at the wet end.

TABLE 15

Polyvinyl amine and zirconium acetate are applied in wet end as a mixture

| | STFI (lb/inch) | Burst (PSI) | Internal bond (mFtlb/inch2) |
|---|---|---|---|
| 5# PVAM | 12.07 | 84.479 | 96.0 |
| 5# PVAM + 0.4# ZrAc co-mix | 12.77 | 88.785 | 102.7 |

Addition of Metal Chelate Only without a Polymer

Example 12 Zirconium Acetate Applied on Wet Web—Tissue Paper

Pulp used in this example was brown stock form Cascade Whitby which was a blend furnish of 50% OCC and 50% MOW. The target basis weight was 35 gsm, typical for tissue and towel grades. Parallel experiments were run, in one experiment, zirconium acetate (5 lb/ton) was applied onto the wet web through 1550 AutoJet Modelar Spray System before drying, in another experiment zirconium was not added. The approximate solid content of the wet web is about 15 to 30%.

Table 16 shows effects of application of ZrAc on wet web only-application. Zirconium acetate addition increased immediate wet tensile by about 39% and permanent wet tensile—wet tensile after 10-minute soak by about 53%. As a result, wet strength decay decreased from 34.1% to 27.4% and wet/dry ratio changed from 6.3% to 8.9% due to zirconium acetate addition.

TABLE 16

ZrAc only applied at wet web

| | CD Dry Tensile gF/inch | CD IWT gF/inch | PWT (10 m soak) gF/inch | 10 min Decay | Wet/Dry |
|---|---|---|---|---|---|
| Blank | 1326 | 83.9 | 55.3 | 34.1% | 6.3% |
| 5# ZrAc | 1318 | 117.2 | 85.1 | 27.4% | 8.9% |
| % increase | | 39% | 53% | | |

Example 13 Zirconium Acetate or Ammonium Zirconium Carbonate Applied on Wet End-Printing and Writing Paper Grades Pulp used in this example was virgin bleached fiber with 50% SW and 50%1 HW. The target basis weight was 75 gsm, typical for printing and writing grades. Parallel experiments were run, in one experiment zirconium acetate (5 lb/ton) was added to the wet end before sheet formation, in the other ammonium zirconium carbonate (5 lb/ton) was added to the wet end before sheet formation, and in another no zirconium was added.

Measured dry tensile, immediate wet tensile and permanent wet tensile—wet tensile after 30 minutes soak data is shown in Table 17.

Comparison of the data in Table 17 shows, dry tensile is increased by about 17% and 7% by the addition of zirconium acetate or ammonium zirconium carbonate respectively, immediate wet tensile is increased by about 87% and 128% by the addition of zirconium acetate and ammonium zirconium carbonate respectively, permanent wet tensile—wet tensile after 30 minutes soak is increased by about 89% and 118% by the addition of zirconium acetate and ammonium zirconium carbonate respectively. Accordingly, wet/dry ratio increased from 3.7% (without zirconium), to 5.9% and 7.9% by the addition of zirconium acetate and ammonium zirconium carbonate respectively.

TABLE 17

Zirconium acetate or ammonium zirconium carbonate applied on wet end

| conditions | CD DT lb/in | CD IWT lb/in | CD 30 m Soak lb/in | DT Increase | IWT Increase | 30 m Soak Increase |
|---|---|---|---|---|---|---|
| blank | 7.62 | 0.283 | 0.194 | | | |
| 5# AZC | 8.14 | 0.645 | 0.423 | 6.8% | 127.9% | 118.1% |
| 5# ZrAc | 8.95 | 0.529 | 0.366 | 17.4% | 86.9% | 88.8% |

Example 14. Zirconium Acetate or Ammonium Zirconium Carbonate Applied on Dry Sheet—Printing and Writing Paper Grades Parallel experiments were conducted. In one set of experiments, 5 lb/ton or 10 lb/ton zirconium acetate were added on the dry sheet through lab scale flooded nip size press. In the other set of experiments, 5 lb/ton or 10 lb/ton ammonium zirconium carbonate were added on the dry sheet through lab scale flooded nip size press. In another experiment, no zirconium was added. The base sheet, in these experiments, were with PCC as the filler, typical for printing and writing grades.

Table 18 shows dry tensile is increased due to addition of ammonium zirconium carbonate or zirconium acetate. It can be seen also that permanent wet tensile—wet tensile after 30 minutes soak is increased due to addition of ammonium zirconium carbonate or zirconium acetate.

TABLE 18

Zirconium acetate or ammonium zirconium carbonate applied on dry sheet

| Condition | Dosage (lb/t) | Dry Tensile (lb/inch) | 30 min soak (lb/inch) |
|---|---|---|---|
| water only | 0 | 12.8 | 0.590 |
| ZrAc | 5 | 13.1 | 0.754 |
| | 10 | 12.6 | 0.720 |
| AZC | 5 | 13.0 | 0.834 |
| | 10 | 13.3 | 1.069 |

Example 15. Zirconium Acetate or Ammonium Zirconium Carbonate Applied on Dry Sheet—Tissue and Towel Grade Pulp used in this example was virgin bleached fiber with 50% SW and 50% HW. The target basis weight was 35 gsm, typical for tissue and towel grades. No other chemicals were used at wet end. Parallel experiments were run, in one experiment zirconium acetate (4.1 lb/ton) was sprayed onto the dry hand sheet through 1550 AutoJet Modular Spray System, in the other experiment, zirconium was not added. The sheet moisture was approximately about 4 to 8%.

Dry tensile, immediate wet tensile, permanent wet tensile—wet tensile after 10 minutes soak of the papers obtained through the above two processes were measured and compared.

Table 19 shows addition of zirconium acetate to the dry hand sheet increases dry tensile by 10%, immediate wet tensile by 121% and permanent wet tensile—wet tensile after 10 minutes by 390%.

TABLE 19

Zirconium acetate or ammonium zirconium carbonate applied on dry sheet

| condition | DT (gF/inch) | IWT (gF/inch) | 10 m soak (gF/inch) |
|---|---|---|---|
| control | 2461 | 33 | 10 |
| 4.1# ZrAc | 2715 | 73 | 49 |

Example 16. Zirconium Acetate or Ammonium Zirconium Carbonate Applied at Wet End-Packaging and Board Grades Pulp used in this example was virgin bleached fiber with 50% SW and 50% HW. The target basis weight was 150 gsm, typical for packaging and board grades. Parallel experiments were run, in one experiment zirconium acetate (5 lb/ton) was added to the wet end, in the other ammonium zirconium carbonate (5 lb/ton) was added to the wet end, and in another no zirconium was added.

Table 20 shows burst strength increases by about 22% and 20% by addition of zirconium acetate and ammonium zirconium carbonate, respectively. STFI increases by about 5% and 4% by addition of zirconium acetate and ammonium zirconium carbonate, respectively. Internal bond increases by about 110% and 6% by addition of zirconium acetate and ammonium zirconium carbonate, respectively.

TABLE 20

Zirconium acetate or ammonium zirconium carbonate applied at wet end

| chemical | Dose (lb/t) | STFI lb/in | Burst lb/in | Internal bond mFt. lb/inch$^2$ |
|---|---|---|---|---|
| blank | | 10.39 | 60.336 | 80.5 |
| ZrAc | 5 | 10.86 | 73.765 | 89.3 |
| AZC | 5 | 10.84 | 72.138 | 85.0 |

Organic Strength Polymer with or without Zirconium

In the following examples PAE products used included wet-strength polyamidoamine-epichlorohydrine (WS-PAE, having epichlorohydrin:amine molar ratio of at least 0.80) as an example of organic permanent wet strength polymer and non-wet strength polyamidoamine-epichlorohydrin (NWS-PAE, a light crosslinked PAE having epichlorohydrin:amine molar ratio of less than 0.50) as an example of organic dry strength booster and non-wet strength polymer. In terms of the condition of pre-mix, PAE and ZrAc were mixed at target ratio for 1 minute prior to dosing to the pulp at wet end or spraying onto the dry sheet. The dosage of PAE was referred to total solids; ZrAc or AZC is as $ZrO_2$ solids.

Example 17. WS-PAE Applied at Wet End Sequentially or as a Mixture with Zirconium Acetate Printing and Writing Paper Grades Pulp used in this example was virgin bleached fiber with 50% SW and 50% HW. The target basis weight is 70 gsm, which is typical for printing and writing grades. This application can be also used for consumer towel grades. Both WS-PAE and zirconium acetate were added at the wet end before the sheet was formed.

As is shown in Table 21 ZrAc can increase both immediate and 30-minute soak wet tensile with WS-PAE. When used with WS-PAE separately, ZrAc did not show significant improvement on dry tensile (Table 21). When comixed with WS-PAE, 13.0% IWT increase and 13.2% PWT increase were achieved compared to 5 lb/ton of WS-PAE used alone. As a result, ZrAc can also increase wet/dry ratio (from 15.9% to 17.1%) (FIG. 38). Note that ZrAc also increased the dry tensile by 5% for both comix and sequential addition. The wet/dry ratio is calculated by immediate wet tensile divided by dry tensile.

TABLE 21

WS-PAE applied at wet end sequentially or as a mixture with zirconium acetate

| Condition | CD DT lb/in | CD IWT lb/in | CD 30 m Soak lb/in | Wet/Dry | 30 min decay |
|---|---|---|---|---|---|
| 5# WS-PAE | 8.62 | 1.370 | 1.283 | 15.9% | 6.4% |
| 5# WS-PAE + 0.4 #ZrAc add separately | 9.08 | 1.379 | 1.284 | 15.2% | 6.9% |
| 5# WS-PAE + 0.4 #ZrAc co-mix | 9.06 | 1.548 | 1.452 | 17.1% | 6.2% |

Example 18. NWS-PAE Applied at Wet End Alone or with Zirconium Acetate Sequentially or as a Mixture—Printing and Writing Paper Grades Pulp used in this example was virgin bleached fiber with 50% SW and 50% HW. The target basis weight is 70 gsm, which is typical for printing and writing grades. This application can be also used for consumer towel grades. Both NWS-PAE and zirconium acetate were added at the wet end before the sheet was formed.

In table 22 it is shown that when ZrAc and NWS-PAE were added sequentially, the dry tensile increased 10%, the immediate wet tensile increased 5%, and the 30-minute soak wet tensile increased 17%. Co-mixing ZrAc (0.5 lb/ton) with NWS-PAE prior to the addition to the pulp slurry gave 18% increase on DT, 22% on IWT, and 48% PWT (30 min soak)) compared to 5 lb/ton of NWS-PAE used alone. As a result, the co-mix of ZrAc and NWS-PAE yielded 14% 30-minute wet tensile decay, compared to 29% wet tensile decay using NWS-PAE alone. Note the wet tensile decay is calculated by wet tensile after X-minute soak divided by immediate wet tensile. In addition, comix ZrAc with NWS-PAE showed a better strength increase than the sequential addition.

TABLE 12

NWS-PAE applied at wet end alone or with zirconium acetate sequentially or as a mixture

| | Dry Tensile (lb/inch) | IWT (lb/inch) | PWT (30 min soak) (lb/inch) | 30 min decay |
|---|---|---|---|---|
| 5# NWS-PAE | 10.65 | 1.223 | 0.87 | 29.1% |
| 5# NWS-PAE + 0.5# ZrAc | 11.73 | 1.285 | 1.01 | 21.0% |
| 5# NWS-PAE + 0.5# ZrAc comix | 12.60 | 1.494 | 1.28 | 14.3% |

Example 19 NWS-PAE and Zirconium Acetate Applied as a Comix or Sequentially to Wet Web—Writing and Printing Paper Grades In this example, NWS-PAE at 51b/ton and zirconium acetate (10% of NWS-PAE dosage, i.e., 0.51b/ton) were applied to wet web by comix or sequential addition through 1550 AutoJet Modular Spray System followed by 3M ACCUSPRAY 16580. The base sheet was made from virgin bleached fiber with 50% SW and 50% HW with 70 gsm basis weight. This application is for printing and writing grades and potentially all towel grades.

Table 23 shows that when ZrAc is comixed with NWS-PAE, 0.5 lb/ton ZrAc improved about 28% of IWT and 9% PWT. Comixing NWS-PAE and ZrAc showed 26% and 8% higher IWT and PWT than sequential addition. Dry tensile was not much affected with either comixing or with sequential application.

TABLE 23

NWS-PAE and zirconium acetate applied as a comix or sequentially to wet web

| | Dry Tensile (lb/inch) | IWT (lb/inch) | PWT (30 min) (lb/inch) | Wet/Dry | 30 m Decay |
|---|---|---|---|---|---|
| blank | 10.55 | 0.308 | 0.18 | 2.9% | 41.6% |
| 0.5# ZrAc | 10.90 | 0.359 | 0.23 | 3.3% | 36.3% |
| 5# NWS-PAE | 10.75 | 0.786 | 0.62 | 7.3% | 20.7% |

TABLE 23-continued

NWS-PAE and zirconium acetate applied as a comix or sequentially to wet web

| | Dry Tensile (lb/inch) | IWT (lb/inch) | PWT (30 min) (lb/inch) | Wet/Dry | 30 m Decay |
|---|---|---|---|---|---|
| 5# NWS-PAE + 0.5# ZrAc separately | 10.63 | 0.800 | 0.63 | 7.5% | 21.2% |
| 5# NWS-PAE + 0.5# ZrAc comix | 10.99 | 1.009 | 0.68 | 9.2% | 32.5% |

Example 20. NWS-PAE Applied at Wet End and ZrAc on the Dry Sheet-Printing and Writing Paper Grade In this example, pulp used in this example is virgin bleached fiber with 50% SW and 50% HW. The target basis weight is 70 gsm, which is typical for printing and writing grades. NWS-PAE was applied at wet end, and ZrAc was sprayed onto the dry sheet through 1550 AutoJet Modular Spray System. As can be seen from table 24 the IWT and PWT were increased by 20% and 16% using ZrAc with NWS-PAE, compared to NWS-PAE alone. Dry tensile was not much affected

TABLE 24

NWS-PAE applied at wet end and ZrAc on the dry sheet

| condition | Dry Tensile (lb/inch) | IWT (lb/inch) | PWT (30 min) (lb/inch) |
|---|---|---|---|
| 5# NWS-PAE | 10.14 | 1.021 | 0.80 |
| 5# NWS-PAE + 0.5# ZrAc | 10.37 | 1.222 | 0.93 |
| %-increase | | 20 | 16 |

What is claimed is:

1. A method for manufacturing paper with improved strength, comprising steps of:

providing a thick stock, being a cellulosic fiber suspension having a consistency of above 20 g/l;

diluting the thick stock with white water or other circulating water into a thin stock;

delivering the thin stock to a headbox;

draining the thin stock on a moving screen to form a wet web;

pressing and drying the wet web in a press section and a dryer section to form a dry sheet; wherein the method further comprises:

adding a metal chelate and at least one synthetic cationic polymer to the thick stock, the thin stock, the wet web, or any combination thereof.

2. The method of claim 1, wherein the at least one synthetic cationic polymer is selected from one or more of permanent wet strength polymers (PWS), non-wet strength polymers (NWS), and temporary wet-strength polymers (TWS).

3. The method of claim 1, wherein the metal chelate is a chelate of zirconium or titanium.

4. The method of claim 3, wherein the metal chelate is a chelate of zirconium and selected from the group consisting of zirconium acetate, ammonium zirconium carbonate, potassium zirconium carbonate, zirconium oxychloride, zirconium hydroxychloride, zirconium orthosulphate, zirconium propionate, and combinations thereof; preferably zirconium acetate, ammonium zirconium carbonate, potassium zirconium carbonate, and combinations thereof.

5. The method of claim 1, wherein the metal chelate and synthetic cationic polymer is selected such that that when the chelate and the polymer are mixed together viscosity of the mixture is between 1-20,000 cp when measured within an hour from mixing.

6. The method of claim 1, wherein the at least one synthetic cationic polymer is selected from the group consisting of: polyamidoamine epichlorohydrin, poly(epichlorohydin-co-bis(hexamethylene)triamine), polyamidoamine-epichlorohydrin (PAE), polyvinylamine (PVAM), net cationic polyacrylamide, poly(dimethylamine(co)epichlorohydrin), poly(dimethylamine-co-epichlorohydrin-co-ethylenediamine), glyoxalated polyacrylamides (GPAM), polyethylene imine (PEI).

7. The method of claim 1, wherein the metal chelate and the at least one synthetic cationic polymer are added sequentially by adding the polymer first, separately but essentially at same time and same location of the paper making process, or mixed together before adding to the paper making process.

8. The method of claim 7, wherein the metal chelate and the at least one synthetic cationic polymer are mixed together and the mixture is added to the paper making process within at most 10 minutes, of mixing the metal chelate and the at least one polymer together.

9. The method of claim 1, wherein the metal chelate is added in an amount 0.05-20 lb/ton, based on dry weight of cellulosic fiber in wet end stock.

10. The method of claim 1, wherein the synthetic cationic polymer is added in an amount of 0.1-40 lb/ton based on dry weight of cellulosic fiber in the wet end stock.

11. The method of claim 1, wherein the metal chelate and/or the at least one synthetic cationic polymer and/or the metal chelate synthetic polymer mixture is added with a spray, on a gravure roll, an ink jet, or a printing press.

12. The method of claim 1, wherein the wet end stock comprises virgin cellulosic fiber material, recycled fiber, non-wood fiber, or any combination thereof.

13. The method of claim 12, wherein the paper is towel paper, tissue paper, napkin paper, multilayer board, or liner/box board.

14. The method of claim 1, wherein wet tensile and/or immediate wet tensile and/or permanent wet tensile and/or dry tensile and/or burst and/or STFI and/or stiffness and/or internal bonding and/or ply bonding and/or ring crush and/or wax pick and/or ink test and/or IGT and/or decay of the paper improves due to the addition of the metal chelate and the at least one synthetic cationic polymer.

15. The method of claim 14, wherein wet/dry ratio of the paper calculated by dividing an immediate wet tensile value of the paper by a dry tensile value of the paper, improves by at least 2 point increase in % in wet/dry ratio, due to the addition of the metal chelate or the metal chelate and the at least one synthetic cationic polymer.

* * * * *